US010745966B2

(12) United States Patent
Chen et al.

(10) Patent No.: US 10,745,966 B2
(45) Date of Patent: Aug. 18, 2020

(54) SUPPORT STRUCTURE FOR ROLLER FOR A SHADE

(71) Applicant: NIEN MADE ENTERPRISE CO., LTD., Taichung (TW)

(72) Inventors: Lin Chen, Guangdong (CN); Keng-Hao Nien, Taichung (TW)

(73) Assignee: NIEN MADE ENTERPRISE CO., LTD., Taichung (TW)

( * ) Notice: Subject to any disclaimer, the term of this patent is extended or adjusted under 35 U.S.C. 154(b) by 303 days.

(21) Appl. No.: 15/788,371

(22) Filed: Oct. 19, 2017

(65) Prior Publication Data

US 2018/0112462 A1 Apr. 26, 2018

(30) Foreign Application Priority Data

Oct. 20, 2016 (CN) ..... 2016 2 1140355 U

(51) Int. Cl.
*E06B 9/50* (2006.01)
*E06B 9/42* (2006.01)

(52) U.S. Cl.
CPC ..... *E06B 9/42* (2013.01)

(58) Field of Classification Search
CPC ... E06B 9/42; E06B 9/50; E06B 9/174; A47H 1/14; A47H 1/142
See application file for complete search history.

(56) References Cited

U.S. PATENT DOCUMENTS 750,848 A * 2/1904 Guiles ..... F24F 13/32 248/208
1,409,722 A * 3/1922 Hutchinson ..... E06B 9/50 248/268
1,520,066 A * 12/1924 Mahoney ..... E06B 9/50 248/254
1,544,550 A * 7/1925 Barrett ..... E06B 9/50 248/268
1,556,733 A * 10/1925 Talbot ..... E06B 9/50 248/267
1,635,700 A * 7/1927 Bigelow ..... E06B 9/50 248/268
2,155,944 A * 4/1939 Weaver ..... E06B 9/307 160/174 R
2,307,095 A * 1/1943 Zaferakis ..... E06B 9/60 160/263
2,420,977 A * 5/1947 Pye ..... E06B 9/50 248/258

(Continued)

*Primary Examiner* — Johnnie A. Shablack
(74) *Attorney, Agent, or Firm* — Muncy, Geissler, Olds, & Lowe, P.C.

(57) ABSTRACT

A support structure for a roller for a shade includes a bracket, a plug and a limit member. The bracket is adapted to fix on a fixing member, and includes a connecting hole. The plug has one end connected to a shaft tube of the shade, and the other end thereof is inserted into the connecting hole of the bracket. The limit member is connected to the end of the plug, which is provided for being inserted into the connecting hole of the bracket, whereby the limiting member restrains the plug from detaching from the bracket. By the limit member, the connection of the bracket and the plug could be strengthened, so as to prevent the shade from falling off, whereby to enhance the safety of the support structure for the shade in use.

5 Claims, 12 Drawing Sheets

(56) References Cited

U.S. PATENT DOCUMENTS 3,135,369 A * 6/1964 Nisenson ..... E06B 9/90 192/223.4
4,096,904 A * 6/1978 Donofrio ..... E06B 9/90 160/299
4,249,714 A * 2/1981 Boyle ..... E06B 9/50 248/254
4,372,432 A * 2/1983 Waine ..... E06B 9/78 160/307
4,399,857 A * 8/1983 Honma ..... E06B 9/50 160/323.1
4,487,245 A * 12/1984 Shinohara ..... E06B 9/60 160/313
RE31,793 E * 1/1985 Berman ..... E06B 9/50 160/298
4,538,785 A * 9/1985 Damsgaard ..... E06B 9/50 248/268
4,729,418 A * 3/1988 Rude ..... E06B 9/60 160/323.1
4,751,953 A * 6/1988 Appel ..... E06B 9/50 160/313
4,779,662 A * 10/1988 Wilk ..... E06B 9/90 160/298
4,781,234 A * 11/1988 Okumura ..... B60R 5/047 160/23.1
5,031,682 A * 7/1991 Tedeschi ..... E06B 9/60 160/315
5,351,743 A * 10/1994 Jackson ..... E06B 9/171 160/310
5,450,891 A * 9/1995 Benthin ..... E06B 9/50 160/323.1
5,586,631 A * 12/1996 Benthin ..... E06B 9/50 160/297
5,881,792 A * 3/1999 Cheng ..... E06B 9/44 160/263
5,881,793 A * 3/1999 Righter ..... B60R 5/047 160/323.1
6,173,825 B1 * 1/2001 Liu ..... E06B 9/42 160/298
6,289,964 B1 * 9/2001 Colson ..... E06B 9/32 160/121.1
6,457,688 B1 * 10/2002 Welfonder ..... E06B 9/174 160/323.1
6,540,004 B2 * 4/2003 Wu ..... E06B 9/50 160/321
6,709,039 B1 * 3/2004 Davenport ..... B60R 5/047 160/323.1
6,817,402 B1 * 11/2004 Fraczek ..... E06B 9/42 160/323.1
6,843,302 B2 * 1/2005 Nijs ..... E06B 9/56 160/298
6,923,398 B2 * 8/2005 Kosugi ..... B60J 7/068 160/296
7,100,668 B2 * 9/2006 Allsop ..... E06B 9/42 160/321
7,370,686 B2 * 5/2008 Rasmussen ..... E06B 9/50 160/323.1
7,497,242 B2 * 3/2009 Wang ..... E06B 9/42 160/238
7,549,458 B2 * 6/2009 Kwak ..... E06B 9/42 160/319
7,578,334 B2 * 8/2009 Smith ..... E06B 9/262 160/121.1
7,677,293 B2 * 3/2010 Allsopp ..... E06B 9/50 160/321
7,677,294 B2 * 3/2010 Bohlen ..... E06B 9/50 160/323.1
7,740,047 B2 * 6/2010 Koop ..... E06B 9/50 160/323.1
8,151,859 B2 * 4/2012 Koop ..... E06B 9/50 160/325
8,156,993 B2 * 4/2012 Kao ..... E06B 9/42 160/321
8,365,802 B2 * 2/2013 Zhu ..... E06B 9/42 160/291
8,408,486 B2 * 4/2013 Di Stefano ..... E06B 9/42 242/407
8,695,681 B2 * 4/2014 Daniels ..... E06B 9/50 160/291
8,763,676 B2 * 7/2014 Barnes ..... E06B 9/50 160/323.1
8,800,634 B2 * 8/2014 Gramsch ..... E06B 9/50 160/323.1
8,839,841 B2 * 9/2014 Koop ..... E06B 9/50 160/325
8,997,829 B2 * 4/2015 Kao ..... E06B 9/44 160/321
9,060,636 B2 * 6/2015 Cannaverde ..... E06B 9/174
9,151,109 B2 * 10/2015 Kawai ..... E06B 9/262
9,238,939 B2 * 1/2016 Di Stefano ..... E06B 9/42
9,482,050 B2 * 11/2016 Strand ..... E06B 9/42
9,714,539 B2 * 7/2017 Bohlen ..... E06B 9/42
9,816,317 B2 * 11/2017 Chen ..... E06B 9/42
9,926,740 B2 * 3/2018 Pham ..... E06B 9/42
9,951,555 B2 * 4/2018 Klein Tuente ..... A47H 1/142
9,957,752 B2 * 5/2018 Bohlen ..... E06B 9/42
10,428,580 B2 * 10/2019 Vries ..... E06B 9/42
2003/0085003 A1 * 5/2003 Cheng ..... E06B 9/42 160/321
2006/0243402 A1 * 11/2006 Chang ..... E06B 9/40 160/321
2007/0056698 A1 * 3/2007 Lin ..... E06B 9/42 160/313
2007/0119552 A1 * 5/2007 Wang ..... E06B 9/42 160/321
2008/0121353 A1 * 5/2008 Detmer ..... E06B 9/72 160/266
2010/0252211 A1 * 10/2010 Barnes ..... E06B 9/50 160/120
2011/0024064 A1 * 2/2011 Ng ..... E06B 9/42 160/317
2011/0139381 A1 * 6/2011 Daniels ..... E06B 9/50 160/298
2012/0177438 A1 * 7/2012 Ng ..... E06B 9/42 403/293
2013/0000091 A1 * 1/2013 Wills ..... E06B 9/44 29/282
2014/0130989 A1 * 5/2014 Chan ..... E06B 9/68 160/309
2014/0299729 A1 * 10/2014 Wills ..... E06B 9/50 248/254
2015/0083351 A1 * 3/2015 Campagna ..... E06B 9/50 160/310
2015/0300085 A1 * 10/2015 Klein Tuente ..... A47H 1/142 248/267
2015/0300086 A1 * 10/2015 Chen ..... E06B 9/42 160/317
2016/0083999 A1 * 3/2016 Chen ..... E06B 9/42 160/315
2017/0081916 A1 * 3/2017 Greening ..... E06B 9/72
2017/0226799 A1 * 8/2017 Hebeisen ..... E06B 9/80
2018/0112462 A1 * 4/2018 Chen ..... E06B 9/42
2018/0179816 A1 * 6/2018 Cheng ..... E06B 9/82
2018/0209214 A1 * 7/2018 Geiger ..... E06B 9/72
2018/0258694 A1 * 9/2018 Bohlen ..... E06B 9/42
2018/0291682 A1 * 10/2018 Walter-Seifart ..... E04F 10/0648
2018/0355664 A1 * 12/2018 Schorling ..... E06B 9/42
2019/0249488 A1 * 8/2019 Campagna ..... E06B 9/58
2019/0257149 A1 * 8/2019 Lei ..... E06B 9/68
2019/0284875 A1 * 9/2019 Ng ..... E06B 9/50
2019/0316414 A1 * 10/2019 Zhang ..... E06B 9/322

* cited by examiner

SUPPORT STRUCTURE FOR ROLLER FOR A SHADE

BACKGROUND OF THE INVENTION

1. Technical Field

The present disclosure relates generally to a shade, and more particularly to a support structure which is adapted to enhance the structural strength of a roller for the shade.

2. Description of Related Art

A conventional roller shade includes a covering material 1 and a shaft tube 2, as shown in FIG. 1 and FIG. 2, wherein the shaft tube 2 is operable to drive the covering material 1 to be opened or closed. The roller shade could block sunlight shining through a window, in order to make the interior more comfortable. In addition, the roller shade is of privacy protection and attractive decoration, so that the roller shade would become common equipment in houses or offices.

The conventional roller shade has a support structure adapted to support the shaft tube 2 which is rotatable. The support structure includes a plug 3 and a bracket 4. The plug 3 has one end inserted into the shaft tube 2, and the other end thereof has a shaft 3*a* protruded toward the bracket 4. The bracket 4 includes an end plate 4*a* and a side cap 4*b*. The end plate 4*a* is fixed on a wall or a window frame, and has a connecting hole 4*c* adapted to be passed by the shaft 3*a* of the plug 3, in order to install the shaft tube 2. Further, the connecting hole 4*c* is covered by the side cap 4*b*, whereby the support structure could have an attractive appearance.

However, the bracket 4 endures the weight summed up with the covering material 1 and the shaft tube 2, by merely providing the shaft 3*a* passing through the connecting hole 4*c*. Therefore, such assembly manner of the shaft 3*a* and the connecting hole 4*c* would cause the end plate 4*a* or the connecting hole 4*c* deformed easily by loading the total weight thereof. In addition, after a long period of time, the shaft tube 2 itself endures the weight of covering material 1 may gradually sag, either The aforementioned deformation causes the shaft 3*a* of the plug 3 separated from the connecting hole 4*c*, and causes dangers in use. Besides, the appearance and the blocking efficiency of the roller shade would become worse.

BRIEF SUMMARY OF THE INVENTION

In view of the above, the present disclosure provides a support structure for a roller for a shade. By strengthening the connection between the plug and the bracket, the safety of the support structure for the roller for the shade could be enhanced.

The support structure for the roller for the shade provided in the present invention includes a bracket, a plug and a limit member. The bracket is adapted to fix on a fixing member, and includes a connecting hole. The plug has one end connected to a shaft tube of the shade, and the other end of the plug is inserted into the connecting hole of the bracket. The limit member is connected to the end of the plug, which is provided for being inserted into the connecting hole of the bracket, whereby the limit member restrains the plug from detaching from the bracket.

In one embodiment, the bracket includes an end plate and a side cap, the end plate has the connecting hole, the side cap is positioned on a side of the end plate opposite to the plug; the limit member comprises a block connected to the side cap; an end of the plug has a shaft provided thereon, wherein the shaft passes through the connecting hole, and the shaft has a connecting portion, the block of the limit member abuts against the connecting portion.

In one embodiment, the connecting portion of the shaft has a bore, and the block of the limit member passes through the bore.

In one embodiment, the connecting portion of the shaft is at least one groove, and the block of the limit member abuts against the groove.

In one embodiment, the plug comprises a shaft base and an elastic member, the shaft base has a perforation, the shaft is movably positioned in the perforation, the elastic member is positioned within the perforation and pushes the shaft.

In one embodiment, each of two opposite sides of the side cap has a trough, the end plate is inserted into the two troughs via two opposite edges thereof.

In one embodiment, an axial direction of the bore of the shaft is parallel to extension directions of the two troughs of the side cap.

In one embodiment, the bracket comprises an end plate, the end plate has the connecting hole, an end of the plug inserted into the connecting hole has a bore, the limit member includes a pin, the pin is positioned on a side of the bracket opposite to the plug, the pin passes through the bore, and a portion of the pin exposed from the bore abuts against the side of the bracket opposite to the plug.

In one embodiment, the bore has a screw thread, the limit member includes a pad and a screw bolt, the pad is positioned on a side of the bracket opposite to the plug, the screw bolt is formed as the pin, and one end of the screw bolt passes through the pad and is fixed into the bore, and a head of the screw bolt abuts against the pad positioned on the side of the bracket opposite to the plug.

In one embodiment, the bracket further comprises a side cap, the side cap is positioned on a side of the end plate opposite to the plug, and the side cap covers the limit member and the connecting hole.

In one embodiment, the connecting hole of the bracket is non-circularly corresponding to the end of the plug inserted into the connecting hole.

By the limit member, the connection of the bracket and the plug could be strengthened, so as to prevent the shade from falling off, whereby to enhance the safety of the support structure for the shade in use.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
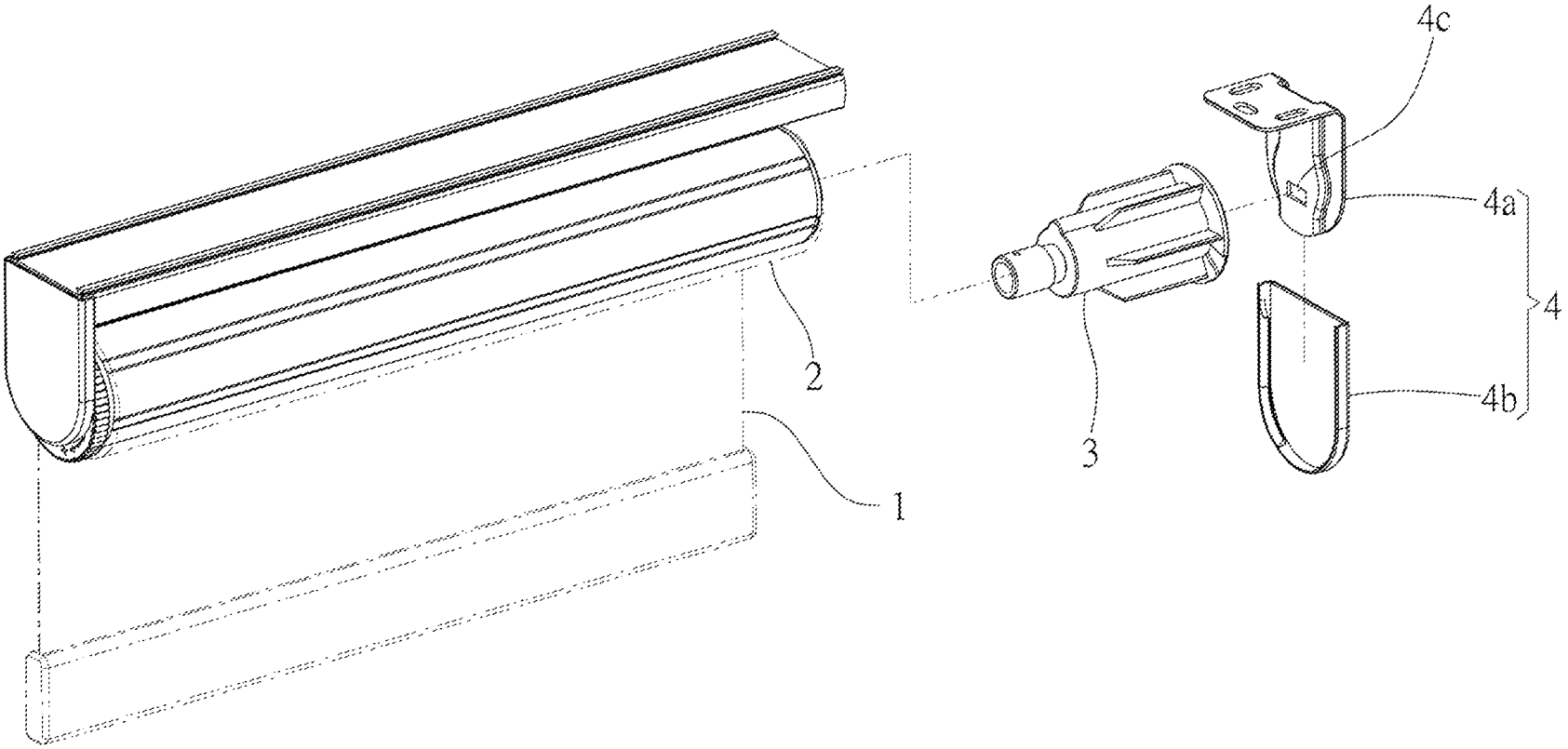
Prior Art FIG. 1
FIG. 1 is a perspective view, showing a conventional roller shade.
Figure 2:
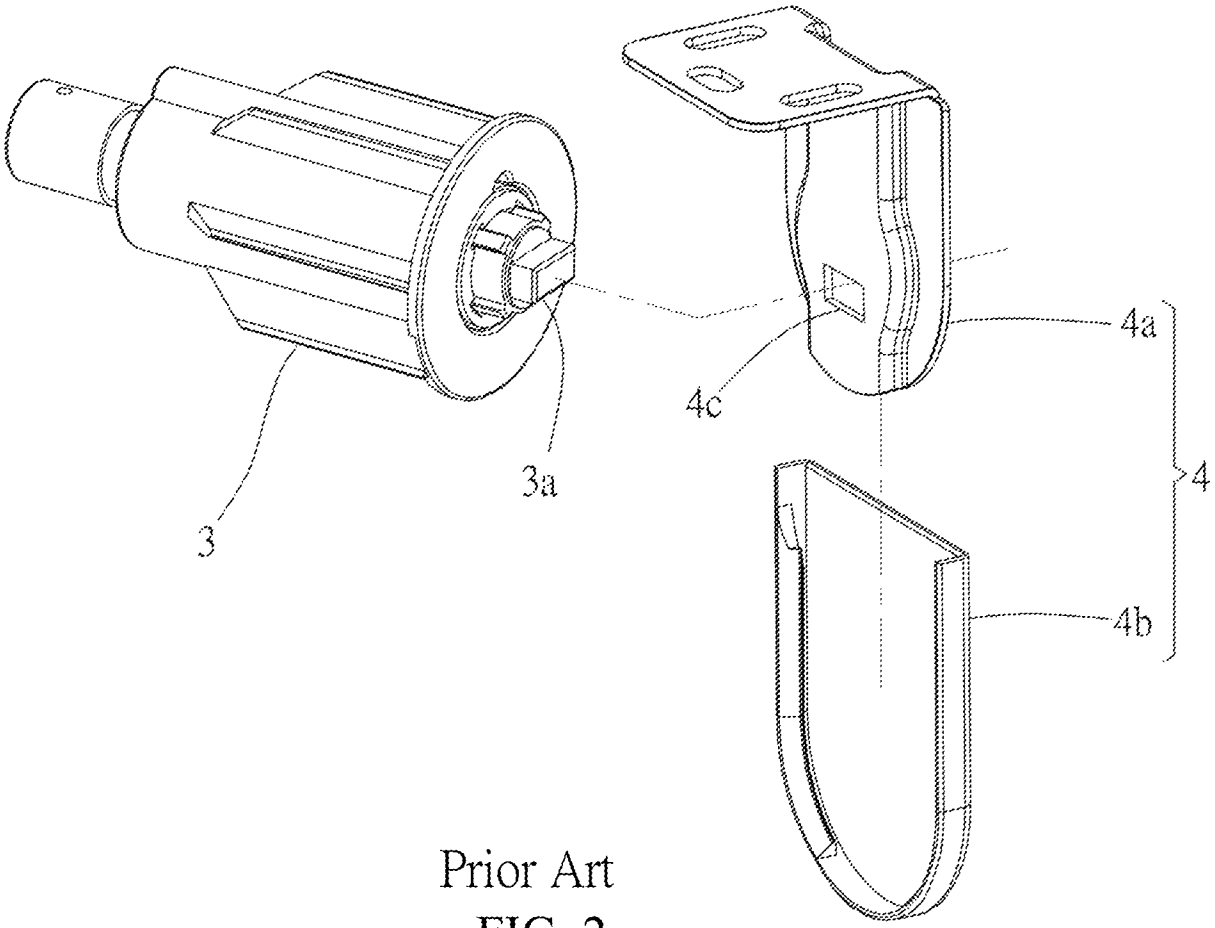
Prior Art FIG. 2
FIG. 2 is an exploded view, showing a support structure of the roller shade shown in FIG. 1.
Figure 3:
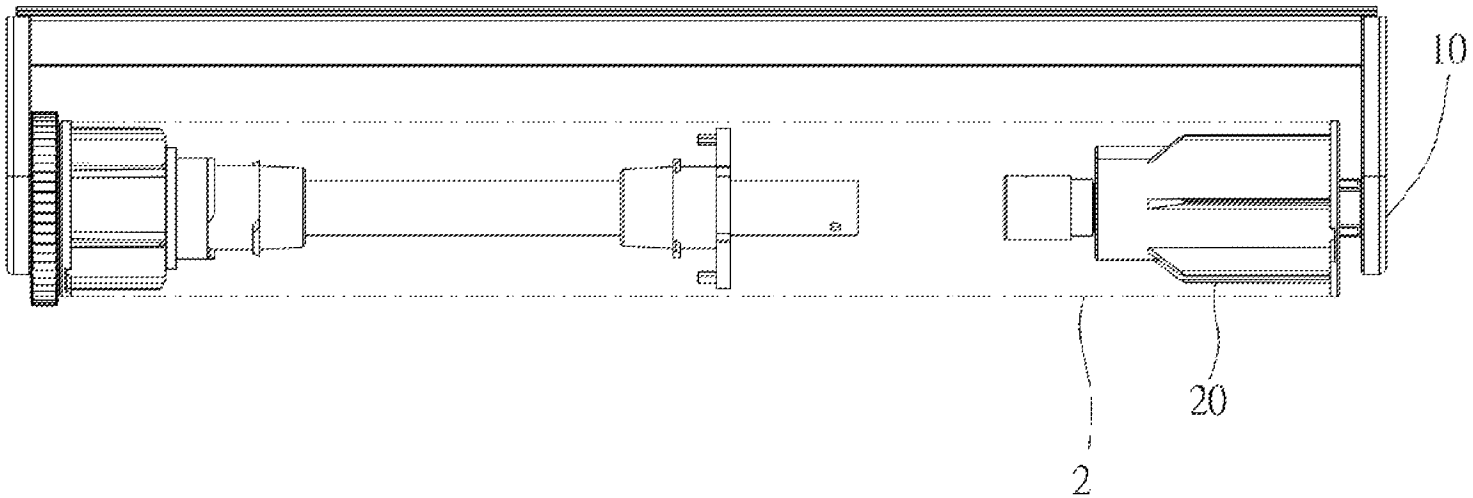
FIG. 3 is a front view, showing a roller shade including a support structure of the first embodiment of the present invention.

For easily understanding the present invention, several embodiments and accompanying drawings are illustrated as the following. Please referring to FIG. 3, a roller shade is provided, which includes a support structure of the first embodiment of the present invention. The support structure includes a bracket 10 and a plug 20.

Figure 4:
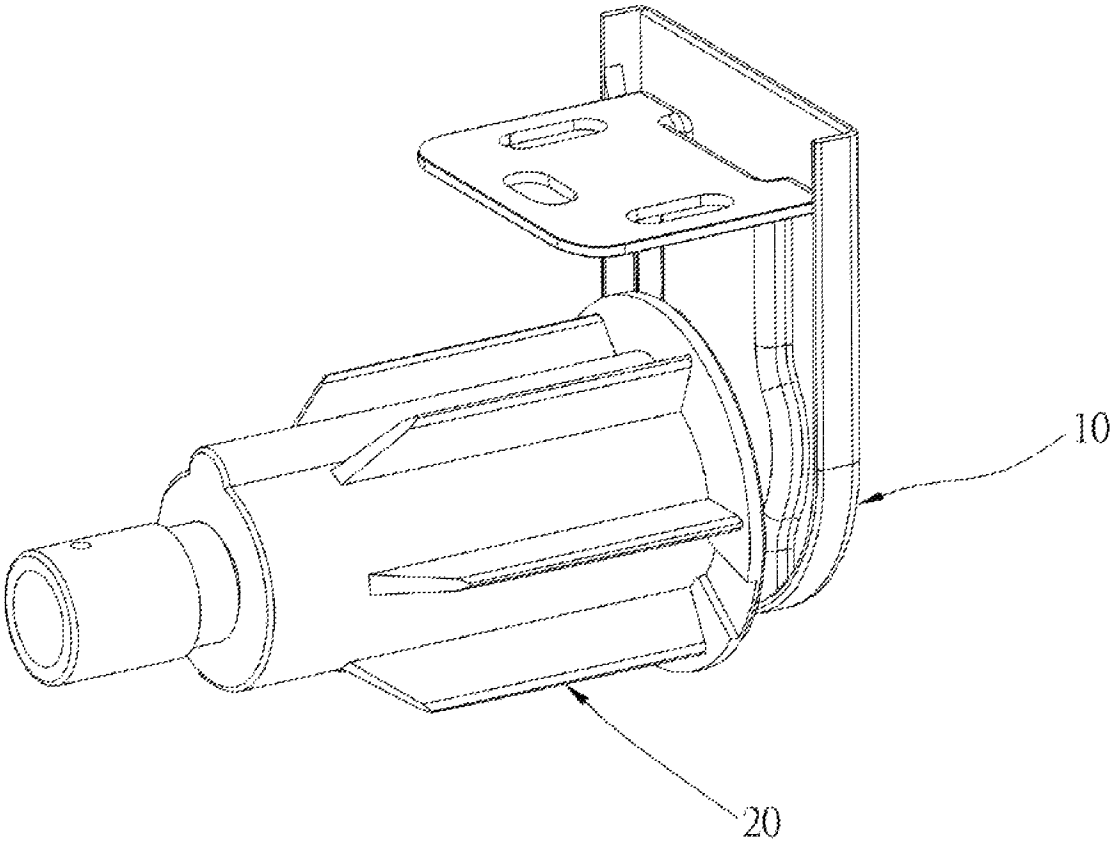
FIG. 4 is a perspective view, showing the support structure of the first embodiment of the present invention.
Figure 5:
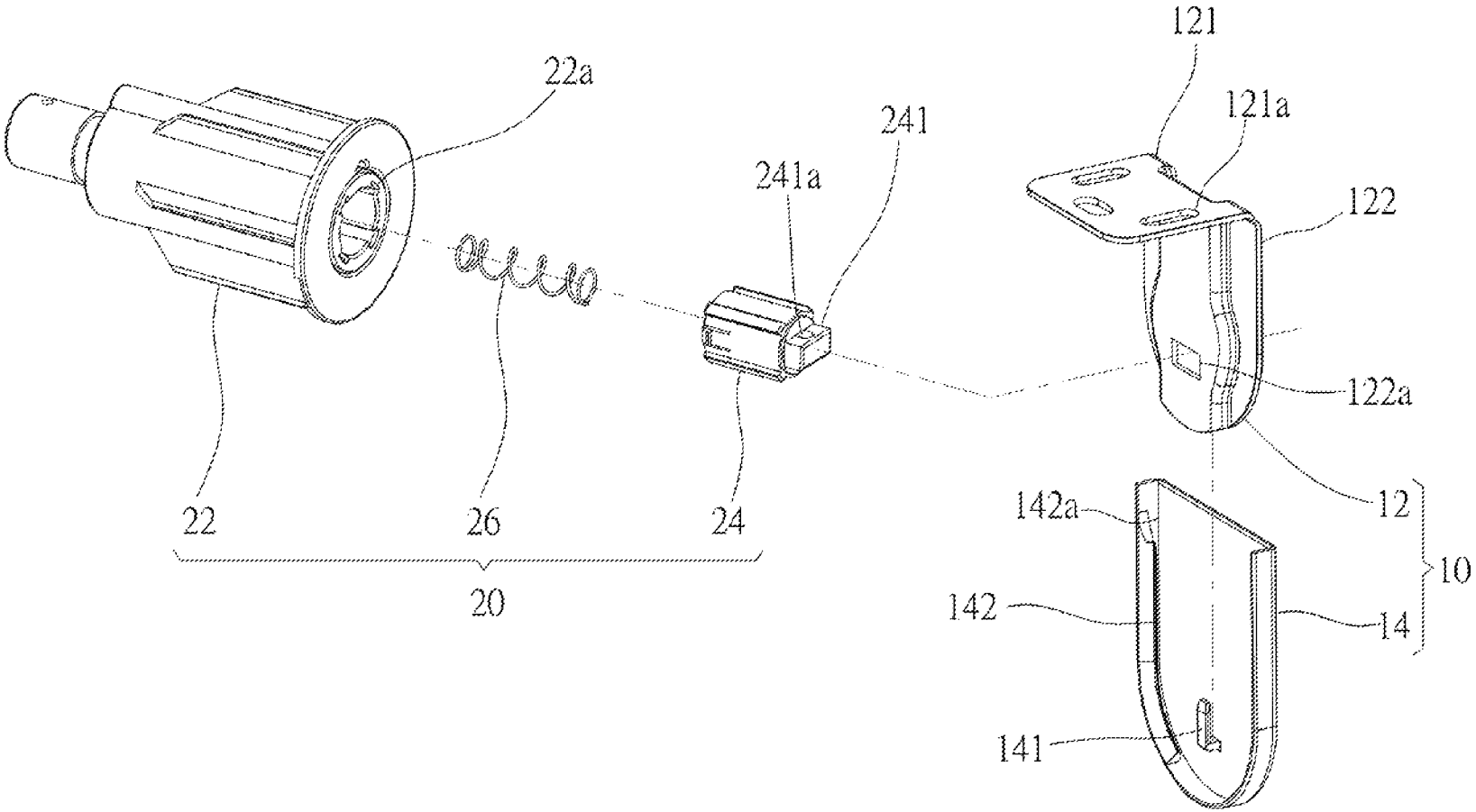
FIG. 5 is an exploded view of the support structure shown in FIG. 4.
Figure 6:
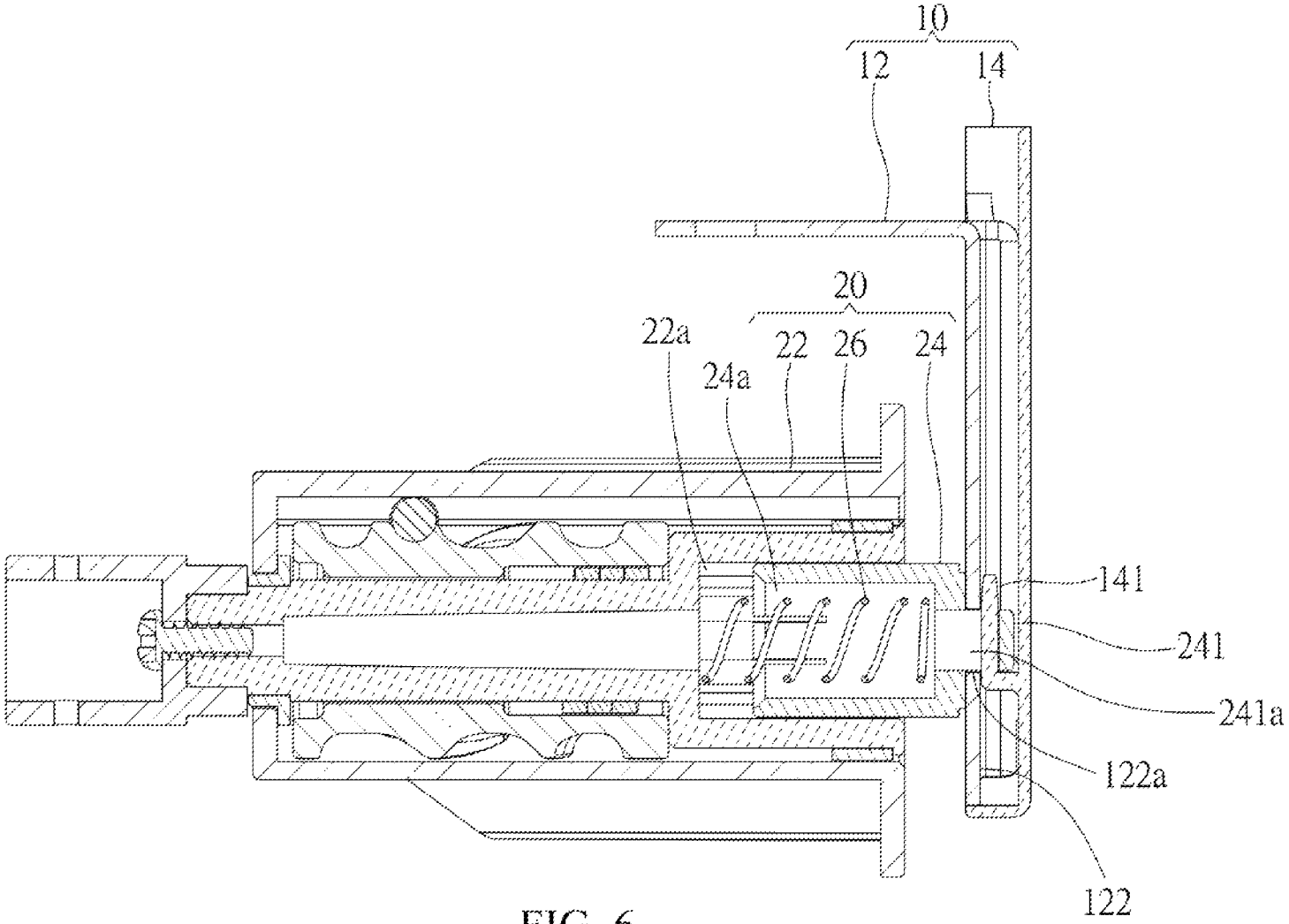
FIG. 6 is a cross-sectional view of FIG. 4.

Referring to FIG. 4 and FIG. 6, the bracket 10 includes an end plate 12 and a side cap 14, wherein the side cap 14 is positioned on a side of the plug 20 opposite to the end plate 12. The end plate 12 is substantially L-shaped, and includes a fixed plate 121 and a connecting plate 122. The fixed plate 121 has a plurality of apertures 121*a*, and the connecting plate 122 has a connecting hole 122*a*. A surface of the side cap 14 facing to the end plate 12 has a block bent upward, which forms as a limit member 141. Each of two sides of the side cap 14 has a trough 142. A top of the trough 142 is an opening end 142*a*.

The plug 20 has a shaft base 22, a shaft 24 and an elastic member 26. The shaft base 22 has a perforation 22*a* formed at an axis thereof, and the shaft 24 is positioned in the perforation 22*a*. The shaft 24 has an orifice 24*a* communicated with the perforation 22*a*, and the perforation 22*a* and the orifice 24*a* are formed an accommodating space. The elastic member 26 is positioned in the accommodating space, and provides a pushing force to the shaft 24 to move the shaft 24 relatively to the shaft base 22. The shaft 24 has a connecting portion 241 formed at a position away from the shaft base 22, wherein the connecting portion 241 is protruded toward the end plate 12, and has a bore 241*a* vertically running through the connecting portion 241.

The components and the positions of the same of the support structure for the roller shade in the first embodiment of the present invention are illustrated as the above mentioned. An installation method of the support structure is further illustrated as follows. As installing the support structure, a unit (e.g., a screw bolt (not shown), but not limited thereto) passes through the aperture 121*a*, whereby to fix the fixed plate 121 on the fixing member (e.g., a wall or a window frame of a building). The plug 20 is inserted into the shaft tube 2 for the roller shade, and then presses the shaft 24 to move toward a deep site of the perforation 22*a*, in order to abut against the connecting board 122. At the moment, the connecting board 122 applies a blocking force to the shaft 24, so that the shaft 24 stays at the deep site of the perforation 22*a*.

When the plug 20 is moved toward the connecting hole 122*a* until approaching a margin of the connecting hole 122*a*, the connecting board 122 is unable to apply the blocking force to the shaft 24. Therefore, the compressed elastic member 24 releases a pushing force to push the shaft 24 outward, so that the connecting portion 241 is engaged with the connecting hole 122*a*. The connecting portion 241 passes through the end plate 12 to expose one side thereof out of the bore 241*a*, such that the shaft base 22 and the bore 241*a* exposed thereby are on two opposite sides of the end plate, respectively.

The opening end 142*a* of the side cap 14 is aligned with a bottom edge of the end plate 12, and the side cap 14 slides from bottom to top. An edge of the end cap 12 is engaged with the troughs 142 of the side cap 14, wherein the limit member 141 passes through the bore 241*a* from top to bottom.

The connecting portion 241 is locked in the connecting hole 122*a*, so that the plug 20 could be fixed on the end plate 12. The side cap 14 abuts against the end plate 12 by the troughs 141, so that the side cap 14 could connect to the end plate 12, whereby to strengthen the end plate 12. At the same time, the limit member 141 passes through the bore 241*a* to abut against the connecting portion 241, in order to distribute the weight of the roller shade loading on the end plate 12, whereby to prevent the bracket 10 from deformation, and to prevent the plug 20 from detaching from the connecting hole 122*a*. Therefore, the roller shade in use is securable.

The connecting hole 122*a* and the connecting portion 241 are rectangular, but are not limited thereto. In practice, once the connecting hole 122*a* and the connecting portion 241 are non-circular, and the connecting portion 241 passes through the connecting hole 122*a*, the plug 20 and the end plate 12 would be not rotatable.

Figure 7:
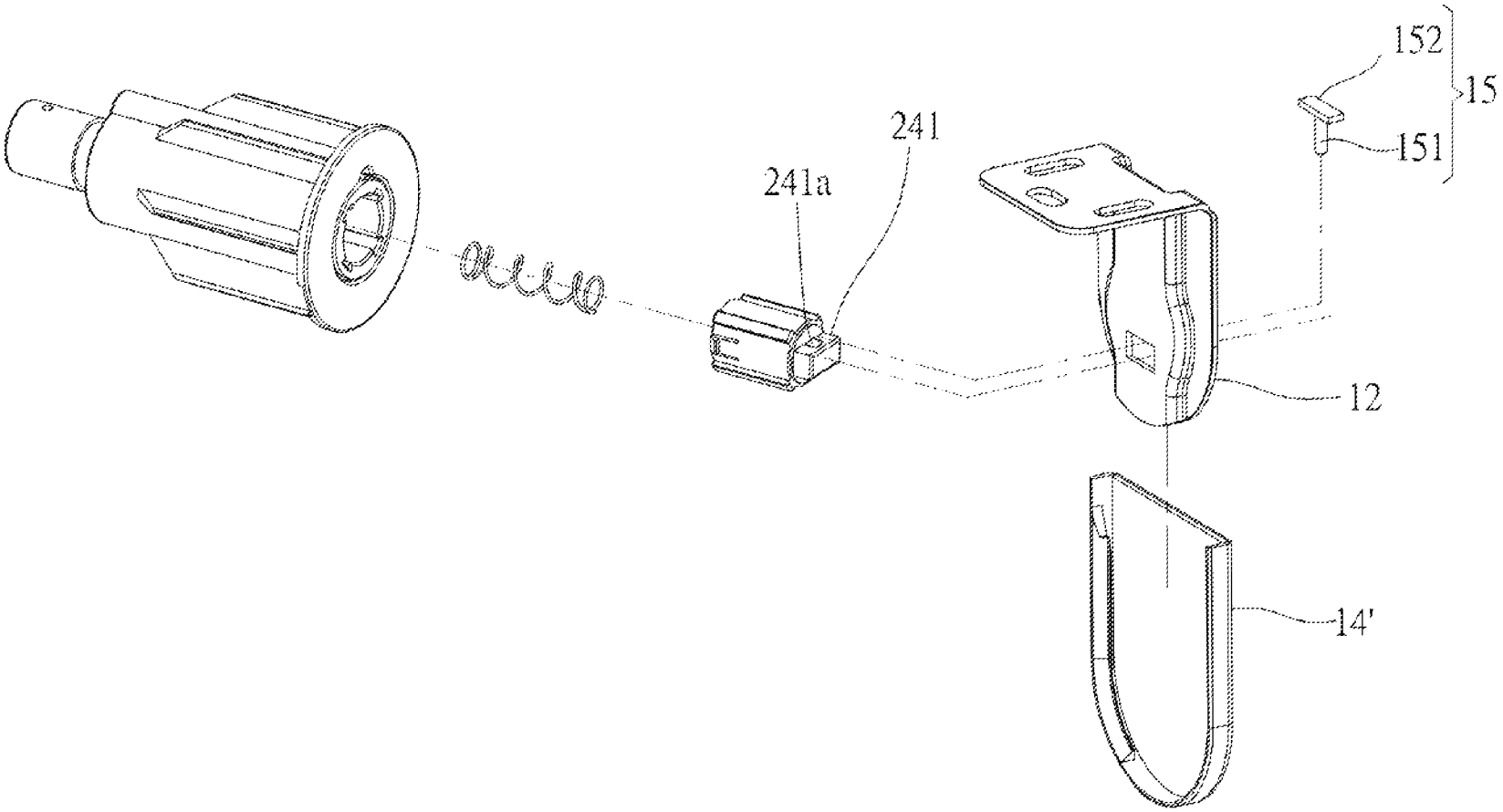
FIG. 7 is an exploded view, showing a support structure for a roller shade of the second embodiment of the present invention.

While the support member has the same plug 20 and the same end plate 12, the limit member could be a pin independent to the side cap. Referring to FIG. 7, the second embodiment of the present invention is provided herein. A side cap 14' does not have a block bent upward. The limit member 15 is a T-shaped pin including a rod 151 and a head 152. The rod 151 passes through the bore 241*a* from top to bottom, and abuts against the end plate 12. The head 152 of the limit member 15 abuts against the end plate 12 and the connecting portion 241, whereby to prevent the limit member 15 from separating from the bore 241*a*, and to fix the plug 20 on the end plate 12. However, though the limit member 15 provided in the second embodiment is a T-shaped pin, and the bore 241*a* vertically runs through the connecting portion 241, they are not limited thereto. In practice, the limit member 15 could be a block (e.g., a wedge) tightly corresponding to the bore 241*a*, and the block still has an exposed portion abutting against the end plate 12 after the block and the bore 241*a* are tightly engaged. Therefore, the function of this case is equivalent to the current embodiment.

Figure 8:
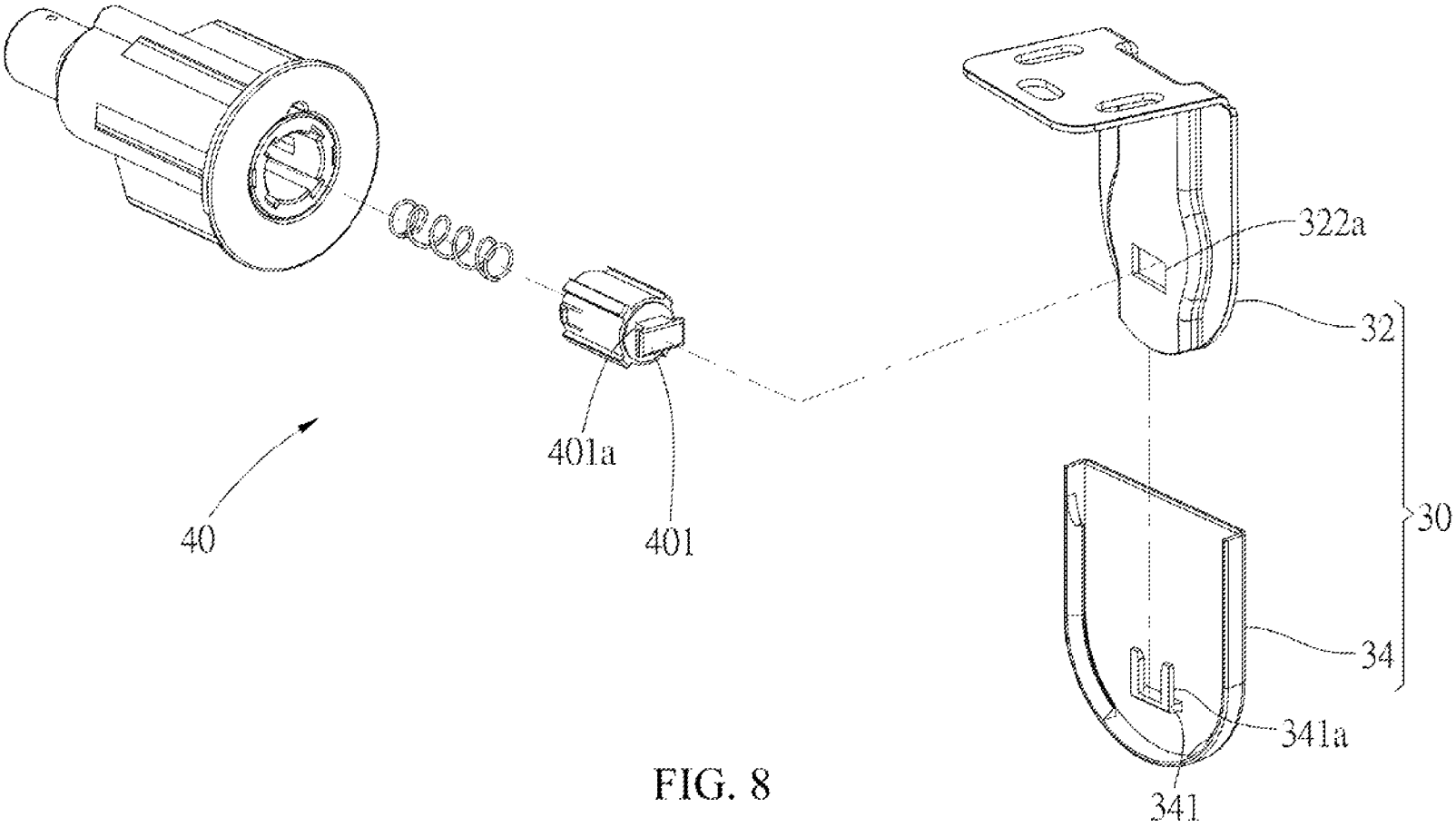
FIG. 8 is an exploded view, showing a support structure for a roller shade of the third embodiment of the present invention.
Figure 9:
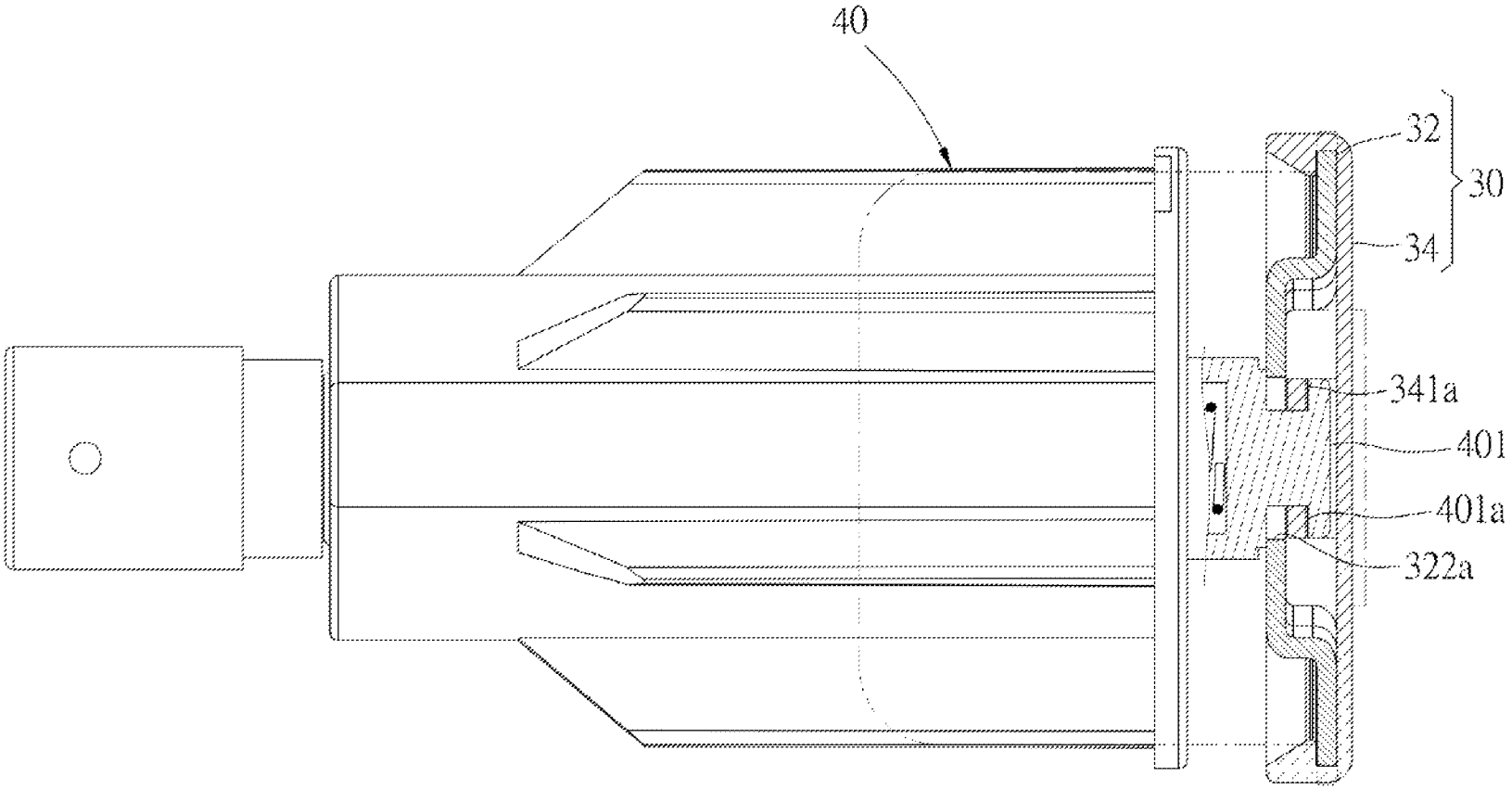
FIG. 9 is a top view of FIG. 8.

In addition, there are several ways to present plug from detaching from the bracket, which are illustrated by the following provided structures. Referring to FIG. 8 and FIG. 9, a support structure for a roller shade in the third embodiment of the present invention is provided herein, includes a bracket 30 and a plug 40. The bracket 30 and the plug 40 in the current embodiment are similar to the bracket 10 and plug 20 in the above-mentioned first embodiment. However, the difference therebetween is that, a surface of a side cap 34 facing to the end plate 32 has a limit member 341 provided thereon, wherein the limit member 341 includes two blocks 341*a* bent upward; a connecting portion 401 of the plug 40 is T-shaped and toward the end plate 32, wherein the connecting portion 401 has two troughs 401*a*. In other words, the connecting portion 401 in the current embodiment has no bore provided thereon.

When the side cap 34 slides from bottom to top, and the blocks 341*a* of the limit member 341 are locked in the troughs 401*a*, respectively, in order to prevent the plug 40 from separating from a connecting hole 322*a* of the end plate 32.

In the first and the third embodiments, the limit member and the side cap are formed integrally in one piece. Further, according to the assembling direction of the embodiments, the limit member is assembled from bottom to top, but is not limited thereto. In practice, the assembling direction of the limit member and the bore (or the trough) should be in the same direction of the connection of the side cap and the end plate.

Figure 10:
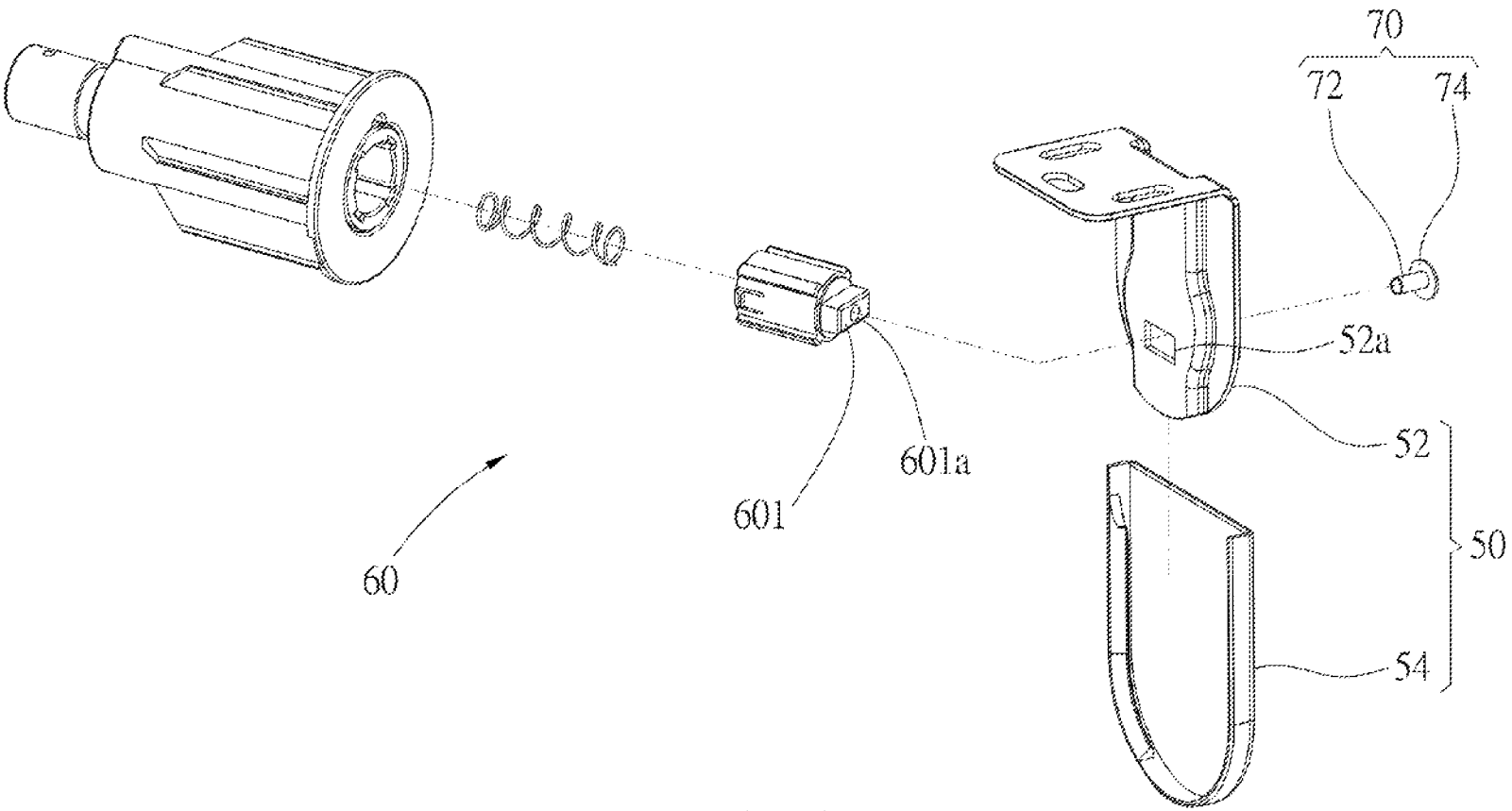
FIG. 10 is an exploded view, showing a support structure for a roller shade of the fourth embodiment of the present invention.

Referring to FIG. 10, a support structure for a roller shade in the fourth embodiment of the present invention is provided herein, and includes a bracket 50, a plug 60 and a limit member 70. The limit member 70 is independent to the side cap 54. The bracket 50 and the plug 60 in the current embodiment are similar to the bracket 10 and plug 20 in the above-mentioned first embodiment. However, the difference therebetween is that, a side cap 54 has no block, and a connecting portion 601 on a shaft of the plug 60 has no bore vertically running through, but has a bore 601*a* formed along the axial direction of the connecting portion 601 instead.

The limit member 70 is a pin including a rod 72 and a head 74 connecting the rod 72. As assembling the support structure, the connecting portion 601 is connected to the connecting hole 52*a*, and a terminal of the connecting portion 601 is aligned with a surface of the end plate 52 near the side cap 54. Further, the rod 72 of the limit member 70 passes through the bore 601*a* from the surface of the end plate 52 near the side cap 54, and the rod 72 and the bore 601*a* are tightly engaged. In addition, the head 74 of the limit member 70 abuts against the end plate 52. Whereby, the plug 60 could be tightly fixed on the end plate 52, so that the plug 60 is not easily detached from the end cap 52. Furthermore, the side cap 54 could cover the protruded head 72 of the limit member 70, whereby the support structure could have an attractive appearance.

Figure 11:
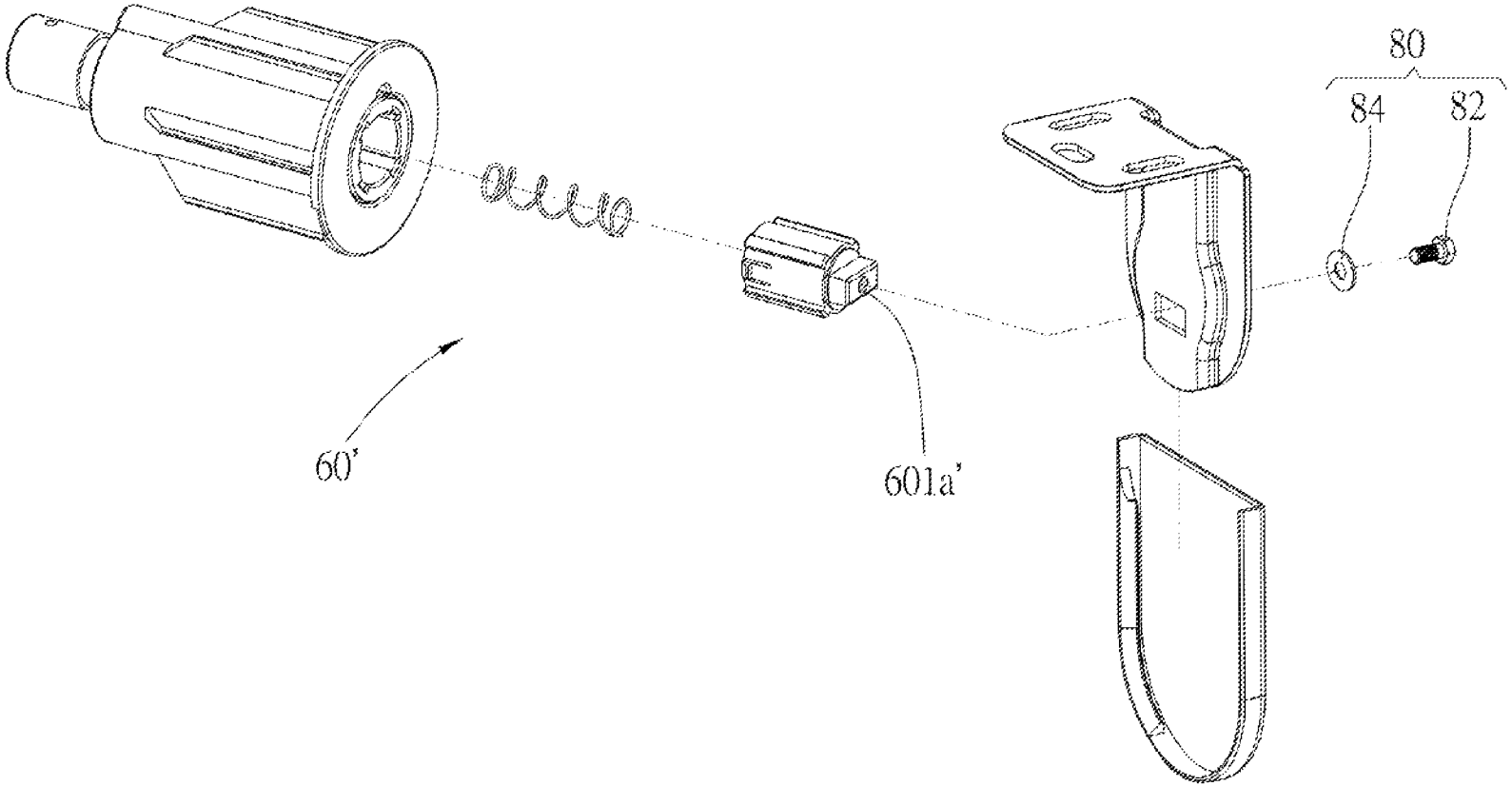
FIG. 11 is an exploded view, showing a support structure for a roller shade of the fifth embodiment of the present invention.
Figure 12:
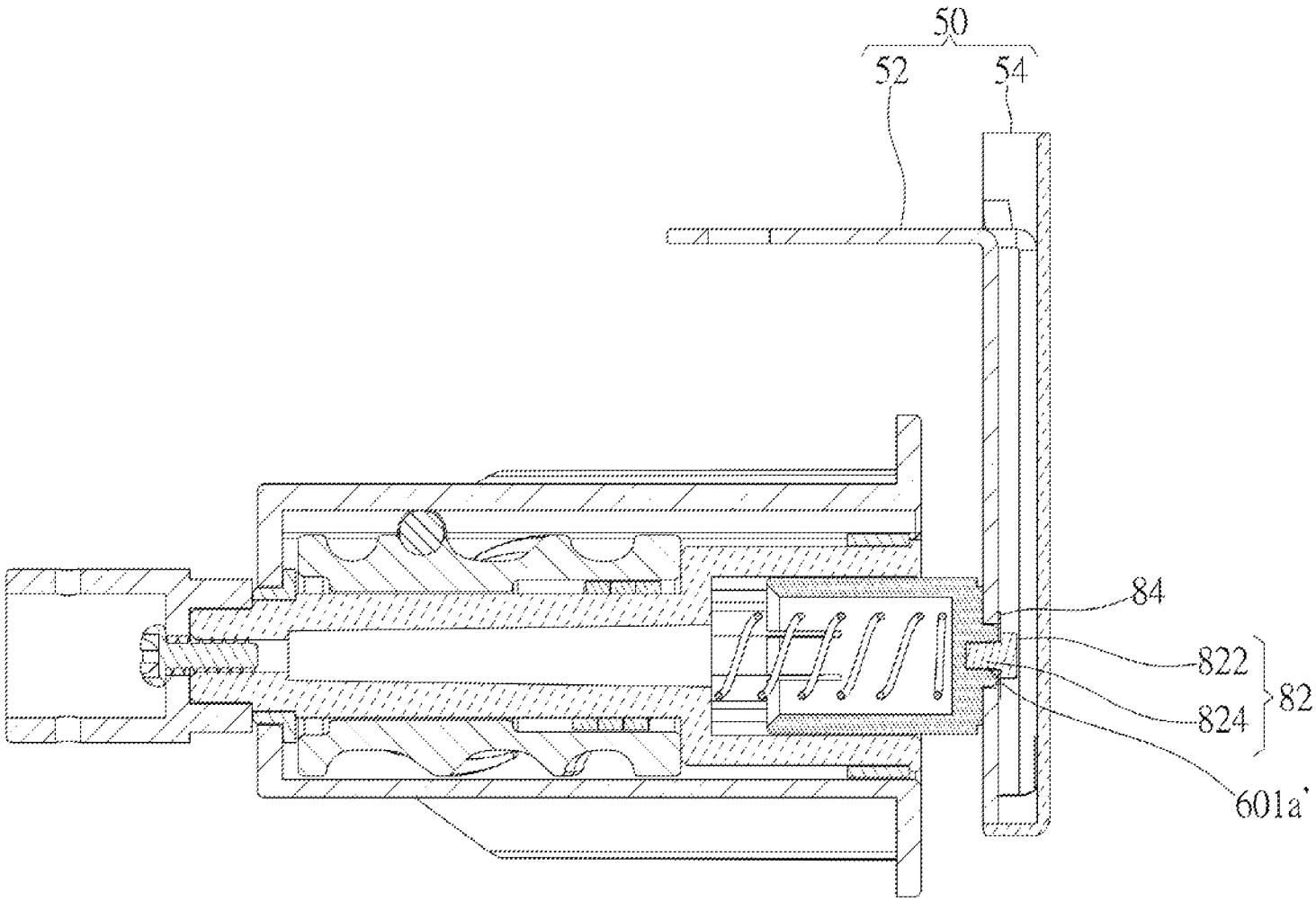
FIG. 12 is a cross-sectional view of FIG. 11.

In another embodiment, referring to FIG. 11 and FIG. 12, for increasing the stability of the limit member fixed on the bore, and preventing the limit member from separating from the bore to affect the plug fixed on the bracket, a bore 601*a*' further includes a screw thread, and a limit member 80 includes a screw bolt 82 and a pad 84. The pad 84 and a plug 60' are on opposite sides of the end plate 52. A screw portion 822 of the screw bolt 82 passes through the pad 84, and is screwed into the bore 601*a*', and a head 824 of the screw bolt 82 abuts against the pad 84, so that the pad 84 could tightly abut against the end plate 52.

It must be pointed out that the embodiments described above are only some preferred embodiments of the present invention. All equivalent structures which employ the concepts disclosed in this specification and the appended claims should fall within the scope of the present invention.

What is claimed is:

1. A support structure positioned on a side of a shaft tube of a roller for a shade, comprising:

a bracket adapted to be fixed on a fixing member, wherein the bracket has a connecting hole;

a plug having two ends, among which one end is connected to the shaft tube of the shade, and the other end is inserted into the connecting hole of the bracket; and a limit member connected to the other end of the plug, whereby the limit member restrains the plug from detaching from the bracket;

wherein the plug has a shaft provided on the other end thereof, and the shaft passes through the connecting hole;

wherein the plug comprises a shaft base and an elastic member; the shaft base has a perforation, and the shaft is movably positioned in the perforation; the elastic member is positioned within the perforation and pushes against the shaft;

wherein the bracket comprises an end plate, and the end plate has the connecting hole; the shaft of the plug has a bore; the limit member comprises a pin;

wherein the shaft of the plug has an end protruding out of the end plate on a side of the end plate, and the bore of the shaft is provided at said end thereof the pin of the limit member passes through the bore on said side of the end plate, and a portion of the pin is exposed out from the bore and abuts against said side of the end plate.

2. The support structure of claim 1, wherein the bracket comprises a side cap, the side cap is positioned on said side of the end plate.

3. The support structure of claim 2, wherein each of two opposite sides of the side cap has a trough, the end plate is inserted into the two troughs via two opposite edges thereof.

4. The support structure of claim 3, wherein an axial direction of the bore of the shaft is parallel to extension directions of the two troughs of the side cap.

5. The support structure of claim 1, wherein the connecting hole of the bracket is non-circularly corresponding to the other end of the plug inserted into the connecting hole.

* * * * *